US005294061A

United States Patent [19]

van Dijk

[11] Patent Number: 5,294,061

[45] Date of Patent: Mar. 15, 1994

[54] METHOD OF REDUCING THE OIL CONTENT OF CUTTINGS AND APPARATUS FOR THE APPLICATION OF SAID METHOD

[75] Inventor: Tom van Dijk, Heerhugowaard, Netherlands

[73] Assignee: SCS Environmental B.V., Den Helder, Netherlands

[21] Appl. No.: 721,513

[22] PCT Filed: Jan. 11, 1990

[86] PCT No.: PCT/NL90/00004

§ 371 Date: Aug. 29, 1991

§ 102(e) Date: Aug. 29, 1991

[87] PCT Pub. No.: WO90/08177

PCT Pub. Date: Jul. 26, 1990

[51] Int. Cl.[5] ..... B02C 11/08; B02C 13/06

[52] U.S. Cl. ..... 241/23; 241/65; 241/188.1; 208/407; 209/11

[58] Field of Search ..... 241/23, 65, 27, 188.1; 208/400, 407, 425, 426; 209/144, 148, 11; 196/120

[56] References Cited

U.S. PATENT DOCUMENTS

| | | | |
|---|---|---|---|
| 2,038,904 | 4/1936 | Rand | 241/65 |
| 3,799,455 | 3/1974 | Szegvari | 241/27 |
| 4,251,236 | 2/1981 | Fattinger et al. | 55/229 X |
| 4,526,678 | 7/1985 | Myhren et al. | 209/148 X |
| 4,533,087 | 8/1985 | Deve | 241/65 |
| 4,651,935 | 3/1987 | Samosky et al. | 241/65 |
| 4,869,810 | 9/1989 | Ellingsen et al. | 208/407 |

*Primary Examiner*—Hien H. Phan
*Assistant Examiner*—Clark F. Dexter
*Attorney, Agent, or Firm*—Hoffmann & Baron

[57] ABSTRACT

A method of reducing the oil content of cuttings, in which the cuttings are introduced into a drum-shaped space, where an elevated temperature is predominant and subjected to a hammering treatment in that space and the drum-shaped space is permanently heated from without so that during the performance of the hammering treatment the temperature in the interior is maintained in the vicinity of, but below, the cracking temperature of the oil in the cuttings to be treated, while further the pressure in the spaces is maintained at a value of at least 0.3 bar gauge. An apparatus for the application of such a method comprises a hammer mill and a dust cyclone, the hammer mill comprising a drum-shaped body, a rotary shaft passed through a side wall of the drum and extending axially through the drum, which shaft can be connected to a motor outside the drum, onto which rotary shaft hammers are mounted which extend into a direction substantially transverse to the shaft reaching up to the vicinity of the inner wall of the drum, the drum further comprises an inlet for feeding cuttings to the drum and outlets for discharging the mist formed in the apparatus in operation and the purified cuttings respectively, the outlet for the mist being connected to the dust cyclone and a heating system being provided around the drum for continuously supplying heat to the drum wall and maintaining it at a high temperature.

19 Claims, 2 Drawing Sheets

Figure 1:
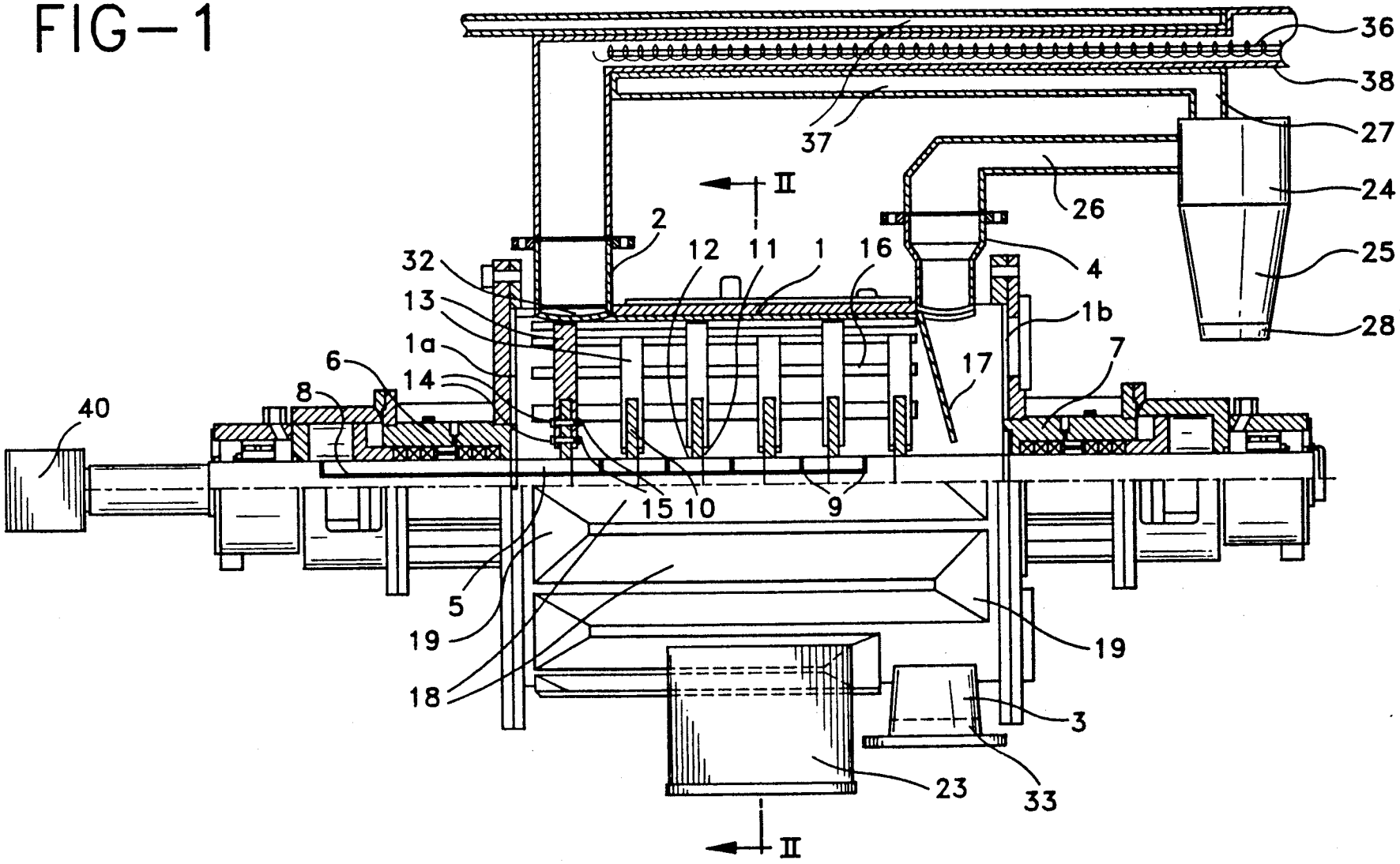

METHOD OF REDUCING THE OIL CONTENT OF CUTTINGS AND APPARATUS FOR THE APPLICATION OF SAID METHOD

The invention relates to a method of reducing the oil content of cuttings, which have been removed from a drilling mud consisting essentially of oil or contaminating oil, in which the cuttings are treated for oil to be extracted from them. The cuttings are fed to a drum-shaped space in which an elevated temperature is predominate and then subjected to a hammering treatment in that space, the temperature being selected so high that oil and water present in the cuttings are substantially converted to corresponding mist and/or vapor, which mist and/or vapor is removed from the drum-shaped shaped space and passed to another space, where any residual dust is removed from the mist and/or vapor, the cuttings being removed from the drum-shaped space in more or less dry form. The invention further relates to an apparatus for the application of the method.

A similar method and apparatus are known from GB patent application 2 165 259. In the known method the elevated temperature in the drum-shaped space is brought about by the heat of friction, which is produced by the rotation of the hammers provided in the drum for carrying out the hammering treatment and by the hammers beating the cuttings. The publication mentioned does not specify what temperature is required in the drum. It is merely observed that the temperature is permitted to be substantially lower than in the then known methods, where temperatures of 260° C. and over were utilized. In its discussion of test results the GB publication mentions a temperature of 172° C., beyond which it is suggested no further changes occur.

Practice has shown that the known method does not lead to satisfactory results. It appears, in particular, that it is difficult to maintain a desired temperature. If the heat of friction generated in the drum brings about a desired high temperature at all, that temperature cannot be controlled.

The object of the present invention is to provide a method which does not exhibit the drawback described above and an apparatus for applying that method.

The object contemplated is achieved in accordance with the invention by the method of the type described in the preamble being characterized in that the drum-shaped space is permanently heated from without, so that during the performance of the hammering treatment the temperature in the interior is maintained throughout in the vicinity of, but below, the cracking temperature of the oil in the cuttings being treated, and further the pressure in the spaces is maintained at a value of at least 0.3 bar above atmospheric pressure.

In the method according to the invention the drum-shaped space is continuously heated from without in a suitable manner, so that in the interior an elevated temperature of for instance at least 185° C. or even more is predominate. In accordance with the invention the temperature in the interior is just below the cracking temperature of the oil present in the cuttings. At such a high temperature the water present in the cuttings will, as it were, explode to form superheated steam, this process being enhanced by the hammering treatment applied to the cuttings. Residual oil in the cuttings will be entrained, so that a fine oil mist or vapor will be formed. The cuttings themselves are pulverized by the hammering treatment, so that a fine and quite homogeneous dust is formed. Pulverizing the cuttings allows the largest possible amount of oil and water to pass from the cuttings. By externally heating the drum-shaped space in which the hammering treatment is conducted, the temperature within the drum can be maintained at a required high level quite accurately, so that the explosive formation of steam entraining with it oil particles from the cuttings, continues without interruption.

In practicing the method according to the invention a gauge pressure of at least 0.3 bar is maintained in the drum and in the space connected to it for separating dust from the water vapor and the oil mist. Such a pressure will be brought about by the generated steam itself if the spaces referred to are kept closed off to a reasonable extent. In addition, the pressure in the system can optionally be maintained at a slightly higher value by introducing nitrogen via a duct connected to the hammer mill. An additional advantage of this option is that the risk of fire in the system is reduced in this way. Typically the gauge pressure will not exceed 1.3 bar. Partly due to the superatmospheric pressure and the action of the hammers the pulverized and purified cuttings will be carried through the drum from the location of supply to a location where the purified and virtually dry cuttings can be carried off. In the dry product the oil content is significantly lower than 5%, amounting to about 2% or less, which is permissible from environmental considerations if they are to be dumped as waste.

The apparatus according to the invention, suitable for applying the method according to the invention, comprises a hammer mill and a dust cyclone, which hammer mill comprises a drum-shaped body, a rotary shaft passed through a side wall of the drum and extending axially through the drum, which shaft can be connected to suitable driving means outside the drum, hammers being mounted onto the rotary shaft, which hammers extend in a direction substantially transverse to the shaft and extend up to the vicinity of the inner wall of the drum, the drum further comprising an inlet for introducing into the drum cuttings containing oil and water and outlets for the mist containing oil, steam and dust, formed during the operation of the apparatus, and the purified cuttings, respectively, the outlet for the mist being connected to the dust cyclone and means being provided around the drum for continuously supplying heat to the drum wall and maintaining it at a high temperature. Preferably, the means for supplying heat to the drum wall and maintaining it at a high temperature comprise a system of chambers provided in or on the drum wall, which are connected to each other in such a way that a fluid passed through these chambers from a location of supply to a location of discharge will pass along by far the greater part of said wall, the system of chambers being connected to a system in which heated thermal oil is circulated so that the thermal oil is introduced into the system of chambers at the location of supply and is removed from the system at the location of discharge.

In a suitable embodiment of the apparatus according to the invention the shaft of the hammer mill, which is bearing-mounted on opposite sides, comprises a plurality of flanges secured to the shaft in spaced interrelationship and extending in a direction substantially transverse to the shaft, a plurality of evenly spaced hammer heads being arranged along the circumference of each flange, the hammer heads of consecutive flanges having a staggered arrangement in a direction parallel to the shaft. In such an arrangement the hammers of consecutive flanges are out of alignment with each other as viewed in the longitudinal direction of the drum. Thus the accumulation of cuttings between the flanges is avoided. Six hammer heads, for instance, are arranged symmetrically along the circumference of each flange. Preferably, the hammer heads are provided on two opposite sides with a layer of very hard material. Hammer heads thus provided on opposite sides with a "hard facing", for instance of tungsten carbide, can in the course of time, be turned around, so that they can be employed longer.

Further, the apparatus according to the invention is preferably constructed in such a way that in the hammer mill the shaft has its greatest diameter in the middle of the drum and is step-wise reduced on opposite sides towards its ends, each flange being welded to the shaft in the vicinity of such a step-wise reduction in such a way that the welds on opposite sides of each flange are at a different distance from the longitudinal axis of the shaft. The advantage of such welds at different levels is that the tendency for the flange secured in this way to become warped will be less. In addition to providing for the optimal connection of the flanges with their hammers, a reduction in opposite directions as described also provides for an improved balance of the shaft and a better distribution of forces in operation. The drum of the hammer mill may further be internally provided with semi-circular profiles extending in a direction parallel to the drum axis and secured to the inner surface in spaced interrelationship. Such semi-circular profiles offer additional protection to the drum, since during operation a "cake" of cuttings and drilling dust is formed on and between such profiles.

Further, in the apparatus according to the invention the dust cyclone, too, may suitably comprise means for maintaining in its interior a temperature which is hardly lower, if at all, than the temperature in the hammer mill. In a preferred embodiment in which the dust cyclone is vertically positioned and essentially comprises an upper cylindrical part and a lower conical part, the wall of the conical part makes an angle not exceeding 20° with the vertical, while the height of the conical part is conventional, so that the dust cyclone has a bigger opening at the lower end than is conventional. The advantage of this is that the dust cyclone is substantially prevented from becoming silted up. If provided, the opening at the lower end of the dust cyclone is preferably closed off by a rotary valve. By means of such a rotary valve, the pressure in the system of hammer mill and dust cyclone can be maintained.

The apparatus according to the invention may be part of a system of purifying stations which collectively form a complete treatment system for cuttings. A conventional treatment system comprises a main washing tank in which cuttings are washed using agitating gear and a washing fluid. The mixture of washing fluid and cuttings is pumped from the main washing tank to two centrifuges in parallel. The cuttings leaving the centrifuges after centrifugation have an oil content of about 8% and are pumped to the apparatus according to the invention via a collecting tank. The washing fluid coming from the two centrifuges referred to is, via a service tank, fed to a third centrifuge, where the residual solid particles are removed down to 2%. These residual solid particles are also fed to the collecting tank of the present apparatus. The washing fluid is used again in the main washing tank.

In the hammer mill of the apparatus according to the invention the oil content of the cuttings is reduced to far below 5%, and the cuttings themselves are pulverized and dried. The dry material is carried off at one end of the hammer mill at the lower end thereof. In the dust cyclone of the apparatus substantially all dust is removed from the water vapor and oil mist. The steam/oil mist is discharged at the top via an outlet. The outlet connected to the dust cyclone for discharging the mist or vapor purified of dust is preferably arranged in a heat exchange relationship with a supply pipe for feeding the cuttings to be purified to the hammer mill. In this way the steam/oil mist is condensed to a mixture of water and oil, while the cuttings to be treated are thus pre-heated in an inexpensive manner. This can be done in a screw condenser, in which a screw conveyor provides for the transport of the cuttings to be purified, while in the casing channels are provided for the steam/oil mist to be passed through, the steam/oil mist cooling down in those channels to a mixture of water and oil of about 60° C. Finally, the water and the oil are readily separated by removing the water by suction.

In yet another suitable embodiment of the apparatus according to the invention, the shaft of the hammer mill comprises a channel provided with openings terminating between the respective flanges for optionally introducing water and/or chemicals into the hammer mill. This embodiment allows water to be injected if more steam is to be generated in types of cuttings having a low water content. Chemicals may optionally be fed to the apparatus for various purposes. In certain cases, for instance, it is desirable that a de-emulsifier is introduced.

Figure 3:
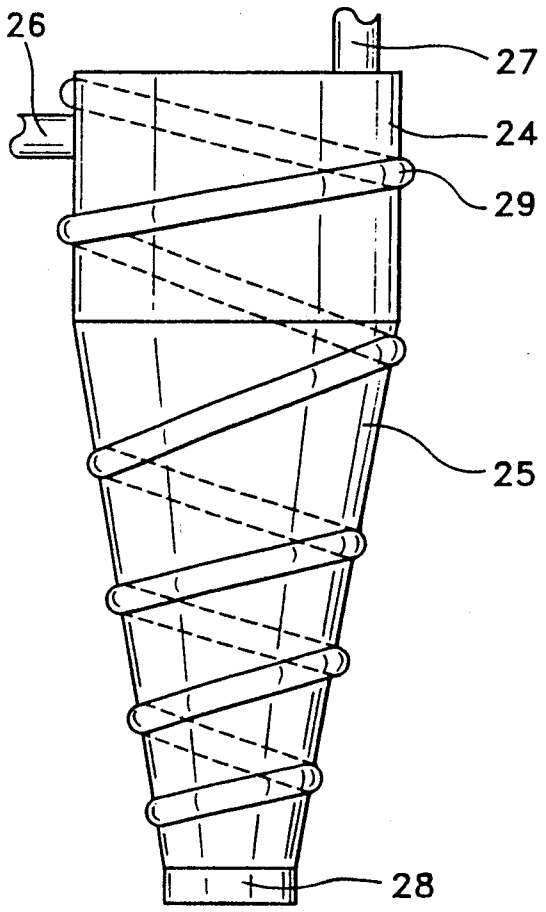
Figure 2:
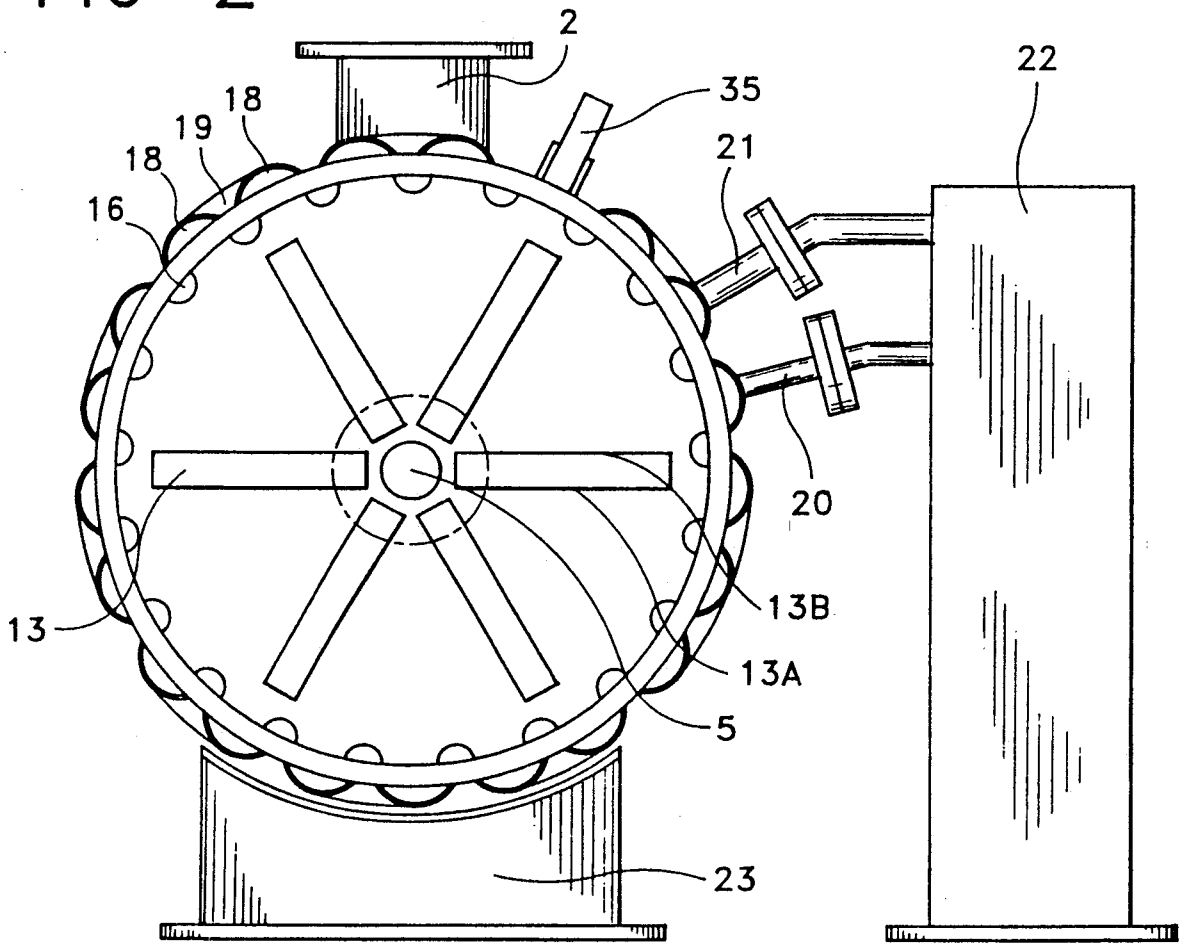

The invention will now be further explained with reference to the accompanying drawings, in which FIG. 1 shows the hammer mill in one embodiment of the apparatus according to the invention, partly in side view and partly in cross-section;

FIG. 2 is a cross-sectional view of the apparatus according to FIG. 1 taken on the line II—II; and FIG. 3 is a schematical cross-sectional view of the dust cyclone in one embodiment of the apparatus according to the invention.

The hammer mill of the apparatus according to the invention shown in FIGS. 1 and 2 comprises an essentially drumshaped body 1, having lateral first and second side walls 1*a* and 1*b*, the drum-shaped body being positioned horizontally. At the top of the drum 1 in the vicinity of one end thereof, a suitable inlet 2 is provided for introducing the cuttings to be purified into the drum. The inlet 2 can be connected to a supply pipe. In the vicinity of the opposite end of the drum 1, in the lower part thereof, an outlet 3 is provided for removing purified and for the greater part pulverized cuttings from the drum. In the top part of the drum 1, above the outlet 3, an outlet 4 is provided for discharging the steam/oil mist generated in the drum during operation, into a dust cyclone 24, 25. The inlet 2 and the outlet 3 are provided with suitable valves, 32, 33 respective so that during operation the pressure in the hammer mill and the dust cyclone connected to it via the outlet 4 can be maintained at a desired value of at least 0.3 bar gauge pressure. In addition, the pressure in the system can optionally be maintained at a slightly higher value by introducing nitrogen via a duct 35 connected to the hammer mill. An additional advantage of this option is that the risk of fire in the system is reduced in this way. Typically, the gauge pressure will not exceed 1.3 bar.

A shaft 5 extends axially through the drum 1, the shaft 5 having been passed through the opposite side walls of the drum 1 and being bearing-mounted on opposite sides outside the drum 1 in tubular members 6 and 7 which are fixedly attached to the drum 1. Shaft 5 may, for instance in the part outside the drum 1, optionally comprised a system of channels (not shown) for cooling the shaft 5 in operation by means of a cooling liquid circulated through this system of channels. The shaft 5 further comprises a channel 8, which at one end terminates outside the drum 1 and at the other end terminates at a number of points 9 within the drum 1 at the surface of the shaft 5. During operation water or another fluid, containing chemicals for instance, may optionally be introduced into the interior of the drum 1 via such a channel 8. The shaft 5 is adapted to be connected to a motor 40, for instance a diesel engine. If such is the case, the existing lubricating oil system of the diesel engine may suitably be used for lubricating and cooling the main bearings and the shaft 5 of the hammer mill of the apparatus according to the invention.

As indicated in FIG. 1 the shaft 5 has its greatest diameter in the middle of the drum 1 and the diameter is step-wise reduced in opposite directions. In the vicinity of each reduction a flange 10 is welded onto shaft 5, in such a way that the welds 11 and 12 are situated at different levels. This is to say that the weld 11 of each flange 10 is situated "before" the reduction and the weld 12 of each flange 10 is situated "after" that reduction. Such a construction prevents the flanges 10 from becoming warped in operation and effects a better distribution of forces during the rotation of the shaft with the flanges, so that the hammer mill will be more balanced. Further it is ensured that the flanges 10 with the hammers attached to them are optimally connected.

Each flange 10 is provided with pairs of through bores at a plurality of points, for instance six, which are evenly spaced along the circumference of the flange. At those points hammer heads 13 are mounted onto the flange 10 and securely attached to it using bolts 14 extending through the bores and nuts 15. The front 13*a* and the back 13*b* of the hammer heads 13 are provided with a hard layer, for instance of tungsten carbide. The hammers on consecutive flanges are arranged in a staggered relation relative to each other, so that the hammers of consecutive flanges are not in one line when viewed in a straight line parallel to the shaft. Such a staggered configuration substantially prevents accumulation of cuttings between the flanges.

Referring to FIGS. 1 and 2, along the inner wall of the drum 1 semi-circular profiles 16 extending in a direction parallel to the shaft in evenly spaced relation relative to each other, are secured to that inner wall, for instance by welding. Such semi-circular profiles protect the inner wall against wear and the like. In operation a protective layer of cuttings and drilling dust forms between the semi-circular profiles 16.

On the side of the outlets 3 and 4 a screen plate 17 is positioned in the drum body. The screen plate 17 prevents pulverized cuttings which are carried along in the apparatus from being entrained into the outlet 4 along with the water vapor or steam and the oil mist formed in the drum 1. Any dust that is swept along with the steam and oil mist is removed from the mist in the dust cyclone, which is connected to the drum 1 via the outlet 4 and, along with the hammer mill, is part of the apparatus according to the invention.

On the outer wall of the drum 1, all around the drum, a large number of elongate channels or chambers 18 are provided, which chambers 18 are connected in pairs with each other at their ends by means of transverse channels 19, in such a way that the system of chambers 18 and transverse channels 19 forms a zig-zag pattern of channels around the drum 1. As illustrated in FIG. 2 in particular, a supply duct 20 and a discharge duct 21 respectively are connected to a pair of adjacent channels 18, which ducts 20 and 21 communicate with an installation 22 for thermal oil, which installation 22 comprises in known manner means for heating a thermal oil contained in the installation 22, maintaining the oil at a desired temperature, and pumping it via the supply duct 20 through the system of channels 18 and 19 and discharging it via the discharge duct 21. In operation this provision enables the exterior of the casing of the drum 1 to be maintained at a desired high temperature of, for instance, 300° C., so that in the interior a high temperature is permanently maintained of, for instance, about 225° C., just below the cracking temperature of the oil to be removed from the cuttings in the apparatus.

Further, at the bottom of the drum 1 a lock 23 is provided which can be opened in order to rapidly empty the drum in case of an emergency or to gain access to the interior if any repairs are to be carried out.

FIG. 3 schematically shows a cross-section of an embodiment of the dust cyclone of the apparatus according to the invention. This dust cyclone comprises in conventional manner a cylindrical upper part 24 and a conical lower part 25 connected to it (dust cyclones are usually positioned vertically). In the present dust cyclone the wall of the conical part makes an angle of less than 20° with the vertical, unlike known dust cyclones, in which this angle is larger. The heights of the cylindrical part and the conical part are comparable to those of the corresponding measurements of the known dust cyclones, so that the opening at the bottom of the dust cyclone has a greater diameter than is usual. Thus clogging during operation is substantially prevented.

On the side wall of the cylindrical part 24 an inlet 26 is provided. To this inlet a duct is connected, which at its other end is connected to the outlet 4 of the hammer mill. The top the dust cyclone is provided with an outlet 27 for discharging from the apparatus the steam and oil mist purified of dust. Connected to the outlet 27 is a discharge duct, which is preferably connected to a heat exchanger, in which the supply of the cuttings to be purified comes into heat exchanging contact with the purified steam and oil mist discharged, for instance by passing the steam and mist through channels, 37 in the casing 38 of a screw conveyor 36 for the cuttings. In this way the temperature of the cuttings is raised even before the cuttings are introduced into the hammer mill. The temperature of the steam and the oil mist is lowered to about 60° C., so that at the end of the heat exchanger a mixture of water and oil comes out that is easy to separate.

The dust cyclone is closed off at the bottom by a rotary dosaging valve 28 of known construction. Since in the duct between the hammer mill and the dust cyclone no further valves are disposed, the pressure in the entire system can be controlled using the rotary valve 28. According to the invention the pressure should be at least 0.3 bar gauge.

The dust cyclone further comprises means for keeping the interior of the cyclone at a high temperature. These means comprise for instance a system of channels 29 extending around the wall of the cyclone, through which system thermal oil is pumped. In this way the temperature in the dust cyclone is maintained at a value which is comparable with that of the temperature in the hammer mill, i.e. a temperature just below the cracking temperature of the oil in the steam and oil mist. All this highly promotes an effective separation of dust and solid particles from the steam and oil mist.

I claim:

1. In a method of reducing oil content of cuttings which have been removed from drilling mud by the steps of subjecting said cuttings to hammering treatment in a drum-shaped space wherein heat produced by said hammering treatment generates an autologous operating temperature sufficient to substantially convert oil and water present in said cuttings to mist and vapor for removal from said drum-shaped space and removing said cuttings from said space in substantially dry form, the improvement comprising the steps of:

adding external heat to said space to attain an elevated temperature throughout the interior thereof which is greater than said autologous operating temperature but below the cracking temperature of the oil in said cutting being treated; and maintaining a pressure in said space during operation at a value of at least 0.3 bar gauge pressure.

2. The method as described in claim 1, wherein the elevated temperature is at least 185° C.

3. The method as described in claim 1, wherein the elevated temperature is maintained in the range of 185° C. to 225° C.

4. The method as described in claim 1, wherein the pressure in said space is maintained at a pressure ranging from 0.3 bar to 1.3 bar gauge pressure.

5. The method as described in claim 1, wherein the pressure in said space is maintained by introducing nitrogen into said space.

6. An apparatus including a hammer mill and a dust cyclone for reducing oil content of cuttings which have been removed from a drilling mud, the hammer mill comprising:

a stationary drum-shaped body having a cylindrical shaped continuous wall closed by lateral first and second side walls to provide an interior space having an interior wall surface, said drum-shaped body also having an inlet and a first outlet extending through a top portion of the drum-shaped body, the inlet for introducing into the interior space the cuttings and the first outlet for directing from the interior space of the drum-shaped body a mist containing oil, steam and dust formed during operation of the hammer mill, and a second outlet extending through a bottom portion of the drum-shaped body for extracting purified cuttings from the interior space of the drum-shaped body;

a rotary shaft passing through at least one of said side walls of the drum-shaped body and extending axially through the interior space of the drum-shaped body, said shaft being connected for rotary movement to driving means outside the drum-shaped body;

a plurality of hammers mounted to said rotary shaft and extending outwardly therefrom to a vicinity proximal said interior wall surface of said drum-shaped body;

said dust cyclone connected to said first outlet of the drum-shaped body, the dust cyclone for separating the dust, oil and water formed during operation of the hammer mill; and means for heating the interior space of the drum-shaped body, said heating means positioned on an exterior surface of said continuous wall of said drum-shaped body.

7. The apparatus according to claim 6, wherein the heating means comprises a system of chambers positioned on said cylindrical shaped continuous wall of the drum-shaped body, said chambers being connected with each other so that a fluid passing through said chambers from a supply location to a discharge location will travel along a greater part of said wall, said chambers being connected to a system in which heated thermal oil is circulated in order to feed the thermal oil into said chambers at the supply location and to remove the thermal oil from said chambers at the discharge location.

8. The apparatus according to claim 6, wherein the rotary shaft is bearing-mounted on opposite sides, and comprises a plurality of flanges secured to the shaft in spaced interrelationship, the flanges extending in a direction substantially transverse to the rotary shaft, the plurality of hammers being arranged on each of the flanges in evenly spaced interrelationship along a circumference of the flange, the hammers of successive flanges being arranged in a staggered configuration relative to each other in a direction parallel to the shaft.

9. The apparatus according to claim 8, wherein the hammers have hammer heads positioned on two opposing sides of the hammers, the hammer heads being formed from a layer of very hard material.

10. The apparatus according to claim 8, wherein the rotary shaft has its greatest diameter at the center of the drum-shaped body, the rotary shaft being step-wise reduced diametrically on opposite sides of its center towards each end of the rotary shaft, each flange being welded to the shaft in the vicinity of the stepped reduction in such a way that welds formed on opposite sides of each flange are differently spaced from an axis of the rotary shaft.

11. The apparatus according to claim 8, wherein the rotary shaft of the hammer mill comprises a channel having openings terminating between the respective flanges for optionally introducing one of water and chemicals into the hammer mill.

12. The apparatus according to claim 6, wherein the dust cyclone comprises:

means for heating an interior space of the dust cyclone, the heating means of the dust cyclone heating the interior space of the dust cyclone to a temperature approximately equal to the temperature in the interior space of the drum-shaped body of the hammer mill.

13. The apparatus according to claim 6, wherein the dust cyclone comprises a cylindrical upper section coupled to a lower conical section, a wall of the conical section forms an angle not exceeding 20° with a vertical axis of the dust cyclone, and wherein the dust cyclone has a relatively large opening at a bottom of the conical section.

14. The apparatus according to claim 13, wherein the opening at the bottom of the conical section of the dust cyclone includes a rotary valve mounted in the opening.

15. The apparatus according to claim 6, wherein the first outlet is connected to an inlet of the dust cyclone for discharging the mist, said cyclone having an outlet disposed in a heat exchanging arrangement with a supply pipe for feeding the cuttings to be purified into the hammer mill.

16. The apparatus according to claim 6, wherein the interior wall surface of the drum-shaped body of the hammer mill comprises semicircular profiles secured to the inner wall surface in spaced interrelationship around the inner wall and extending in a direction parallel to a longitudinal axis of the rotary shaft.

17. The apparatus according to claim 6, further comprising means for pressurizing the interior space of the drum shaped body to a pressure ranging from 0.3 bar to 1.3 bar gauge pressure.

18. The apparatus according to claim 17, wherein the pressurizing means includes means for introducing nitrogen into said interior space.

19. The apparatus according to claim 6, wherein the heating means maintains the interior space of the drum-shaped body at a temperature in a range of about 185° C. to 225° C.

* * * * *